US011065879B2

(12) United States Patent
Mizutani et al.

(10) Patent No.: US 11,065,879 B2
(45) Date of Patent: Jul. 20, 2021

(54) INK REFILL CONTAINER AND INK REFILL SYSTEM

(71) Applicant: SEIKO EPSON CORPORATION, Tokyo (JP)

(72) Inventors: Tadahiro Mizutani, Shiojiri (JP); Ryoichi Tanaka, Shiojiri (JP); Taku Ishizawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/776,217

(22) Filed: Jan. 29, 2020

(65) Prior Publication Data

US 2020/0238715 A1 Jul. 30, 2020

(30) Foreign Application Priority Data

Jan. 30, 2019 (JP) ..... JP2019-014263

(51) Int. Cl.
*B41J 2/175* (2006.01)

(52) U.S. Cl.
CPC ..... *B41J 2/17509* (2013.01); *B41J 2/17513* (2013.01); *B41J 2/17596* (2013.01)

(58) Field of Classification Search
None
See application file for complete search history.

(56) References Cited

U.S. PATENT DOCUMENTS

2007/0171264 A1* 7/2007 Manzone ..... B41J 2/17506 347/85
2014/0174837 A1* 6/2014 Kneubuehl ..... G01G 15/006 177/210 R
2018/0272722 A1* 9/2018 Murphy ..... B41J 2/17513
2018/0272723 A1* 9/2018 Shinada ..... B67D 7/0288
2018/0281432 A1* 10/2018 Kanaya ..... B41J 2/17523
2019/0193405 A1* 6/2019 Suzuki ..... B41J 2/185

FOREIGN PATENT DOCUMENTS

JP S63-021211 U 2/1988

* cited by examiner

*Primary Examiner* — Erica S Lin
*Assistant Examiner* — Tracey M McMillion
(74) *Attorney, Agent, or Firm* — Oliff PLC

(57) ABSTRACT

An ink refill container 31 includes a container body 61 including an inner tube portion 62 constituting an ink containing chamber 41, an inner bottom 64 joined to the inner tube portion 62, an ink-outlet forming portion 38 that is provided in the inner tube portion 62 and that includes an ink outlet 46, and a cover 75 including an outer bottom 76 covering the inner bottom 64 from below. The cover 75 includes a receiving recess 95 that is configured of the outer bottom 76 and a tubular receiving wall 93 integrally coupled to the outer bottom 76 and that receives an ink IK leaked from the ink containing chamber 41 through a junction of the container body 61 and the inner bottom 64.

6 Claims, 10 Drawing Sheets

INK REFILL CONTAINER AND INK REFILL SYSTEM

The present application is based on, and claims priority from JP Application Serial Number 2019-014263, filed Jan. 30, 2019, the disclosure of which is hereby incorporated by reference herein in its entirety.

BACKGROUND

1. Technical Field

The present disclosure relates to an ink refill container and an ink refill system.

2. Related Art

As in the case of JP-UM-A-63-21211, a known liquid container for containing liquid is made by joining a flexible inner bottom plate and an rigid outer bottom plate to a bottom part of a container body so as not to affect the outer appearance of the container, even when the container is filled with heated liquid and the heated liquid is then cooled at a room temperature.

As in the case of a liquid container described in JP-UM-A-63-21211, when a double bottom is configured by joining an inner bottom plate and an outer bottom plate to a bottom part of a container body, joining failure may occur at a junction of the container body and the inner bottom plate and at a junction of the container body and the outer bottom plate. Such joining failure occurs not only as a result of a joining operation but also as a result of a drop of the liquid container when the liquid container is being transported or handled. The liquid container described in JP-UM-A-63-21211 can be applied to an ink refill container for supplying an ink to an ink tank configured to store an ink in the ink tank. However, the above-described joining failure may result in ink leakage to the outside.

SUMMARY

According to an aspect of the present disclosure, an ink refill container including an ink containing chamber configured to contain an ink to be supplied to an ink tank configured to store the ink in the ink tank includes a container bodybody including a peripheral wall of the ink containing chamber, an inner bottom that is joined to the container bodybody and that forms a bottom wall of the ink containing chamber, an ink-outlet forming portion that is provided in the container bodybody and that includes an ink outlet configured to enable the ink to flow out from an inside of the ink containing chamber, and a cover including an outer bottom being opposite to the inner bottom at an outside of the ink containing chamber. When a position in which the outer bottom is positioned below the inner bottom is defined as a reference position of the ink refill container, the cover includes a receiving recess that is configured of the outer bottom and a tubular wall integrally coupled to the outer bottom and extending upward from the outer bottom in the reference position and that receives the ink leaked from the ink containing chamber through a junction of the container bodybody and the inner bottom.

According to an aspect of the present disclosure, an ink refill system including an ink tank configured to store an ink in the ink tank and an ink refill container that contains the ink to be supplied to the ink tank. The ink refill container including an ink containing chamber configured to contain the ink to be supplied to the ink tank configured to store the ink in the ink tank includes a container bodybody including a peripheral wall of the ink containing chamber, an inner bottom that is joined to the container bodybody and that forms a bottom wall of the ink containing chamber, an ink-outlet forming portion that is provided in the container bodybody and that includes an ink outlet configured to enable the ink to flow out from an inside of the ink containing chamber, and a cover including an outer bottom being opposite to the inner bottom at an outside of the ink containing chamber. When a position in which the outer bottom is positioned below the inner bottom is defined as a reference position of the ink refill container, the cover includes a receiving recess that is configured of the outer bottom and a tubular wall integrally coupled to the outer bottom and extending upward from the outer bottom in the reference position and that receives the ink leaked from the ink containing chamber through a junction of the container bodybody and the inner bottom.

DESCRIPTION OF EXEMPLARY EMBODIMENTS

Hereinafter, an embodiment of an ink refill container and an ink refill system will be described with reference to the drawings.

The ink refill container supplies an ink tank of a printer with an ink that is an example of the liquid applied to media such as sheets of paper. The ink tank is mounted in a liquid ejecting device of, for example, an ink jet printer that prints characters and images on the media by ejecting the ink. The ink refill system is configured of such an ink tank and such an ink refill container.

Figure 1:
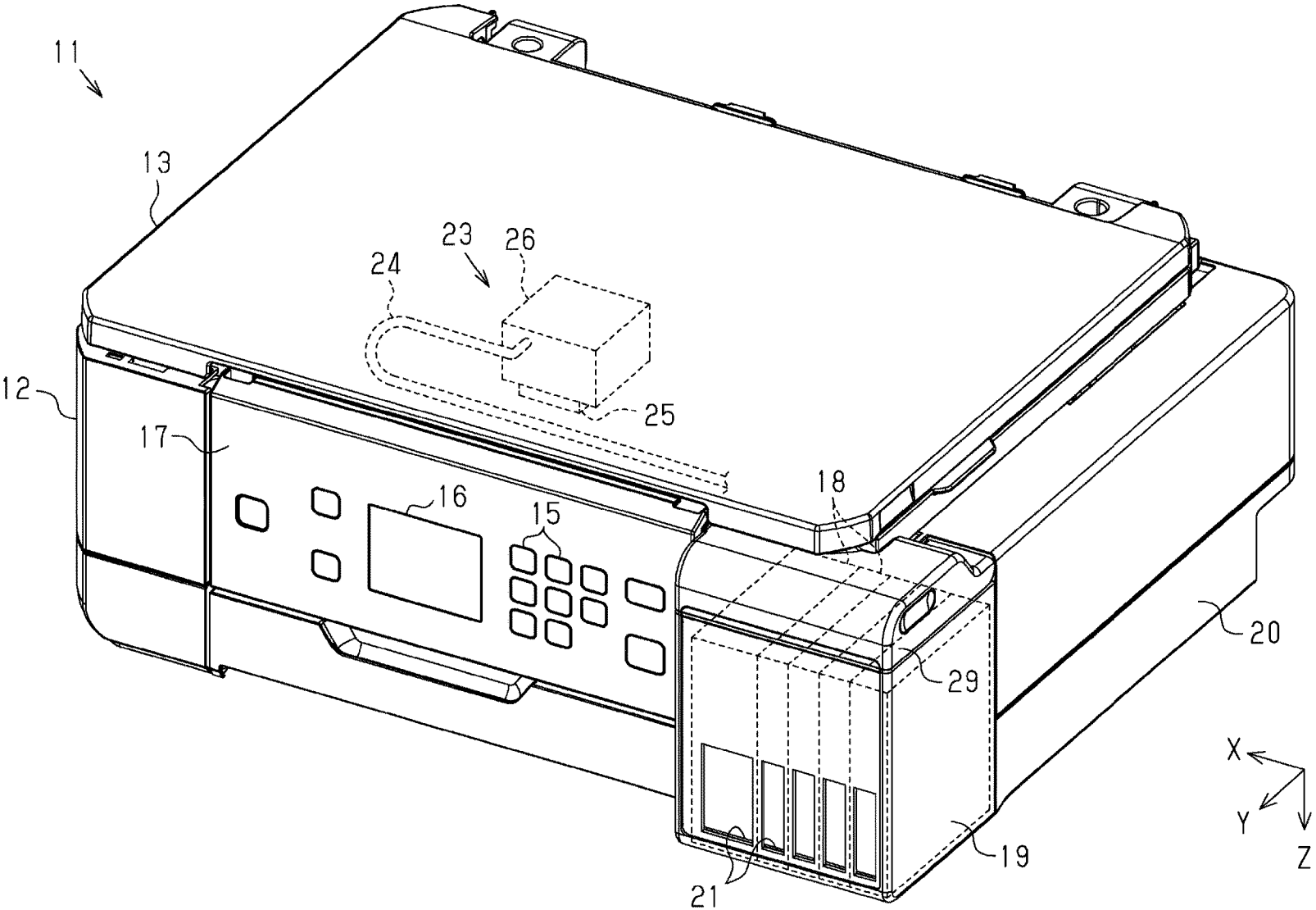
FIG. 1 is a perspective view of a printer incorporating an embodiment of an ink tank constituting an ink refill system.

As illustrated in FIG. 1, a multi-functional machine 11 includes a printer 12 and an image reading device 13 disposed on the printer 12 and forms a substantially rectangular parallelepiped as a whole. Under a condition in which the multi-functional machine 11 is placed on a horizontal plane, the vertical direction is indicated by the Z axis, two directions along the horizontal plane orthogonal to the vertical direction are indicated by the X axis and the Y axis in FIG. 1. The X axis, the Y axis, and the Z axis are orthogonal to one another. In the following description, the direction of the X axis is referred to as the X direction, the direction of the Y axis is referred to as the Y direction, and the direction of the Z axis is referred to as the Z direction.

The printer 12 includes an operation panel 17 including an operation unit 15 and a display 16. The operation unit 15 is configured of components such as buttons for performing various operations of the multi-functional machine 11. The display 16 displays the information related to the printer 12, the multi-functional machine 11, and the like.

The printer 12 incorporates a housing unit 19 for housing at least one ink tank 18. Ink tanks 18 are provided in a housing 20 of the printer 12, and five windows 21 for the respective ink tanks 18 are formed in the housing 20.

The housing 20 incorporates a printing unit 23 that performs printing by causing an ink to adhere to a medium and a supply portion 24 including a component such as a tube that supplies an ink stored in the corresponding ink tank 18 to the printing unit 23. The printing unit 23 includes an ink ejecting head 25 including a nozzle for ejecting an ink and a carriage 26 that holds the ink ejecting head 25 and that can reciprocate in the X direction as the direction of scanning. That is, each ink tank 18 communicates, via such a supply portion 24, with the ink ejecting head 25 and stores an ink to be supplied to the ink ejecting head 25.

The printing unit 23 prints characters, images, and the like, on a medium (not illustrated) by ejecting an ink from the ink ejecting head 25 that moves. In the present embodiment, a plurality of supply portions 24 are provided for the respective ink tanks 18; however, one supply portion 24 is illustrated in FIG. 1 for a simple illustration.

Figure 2:
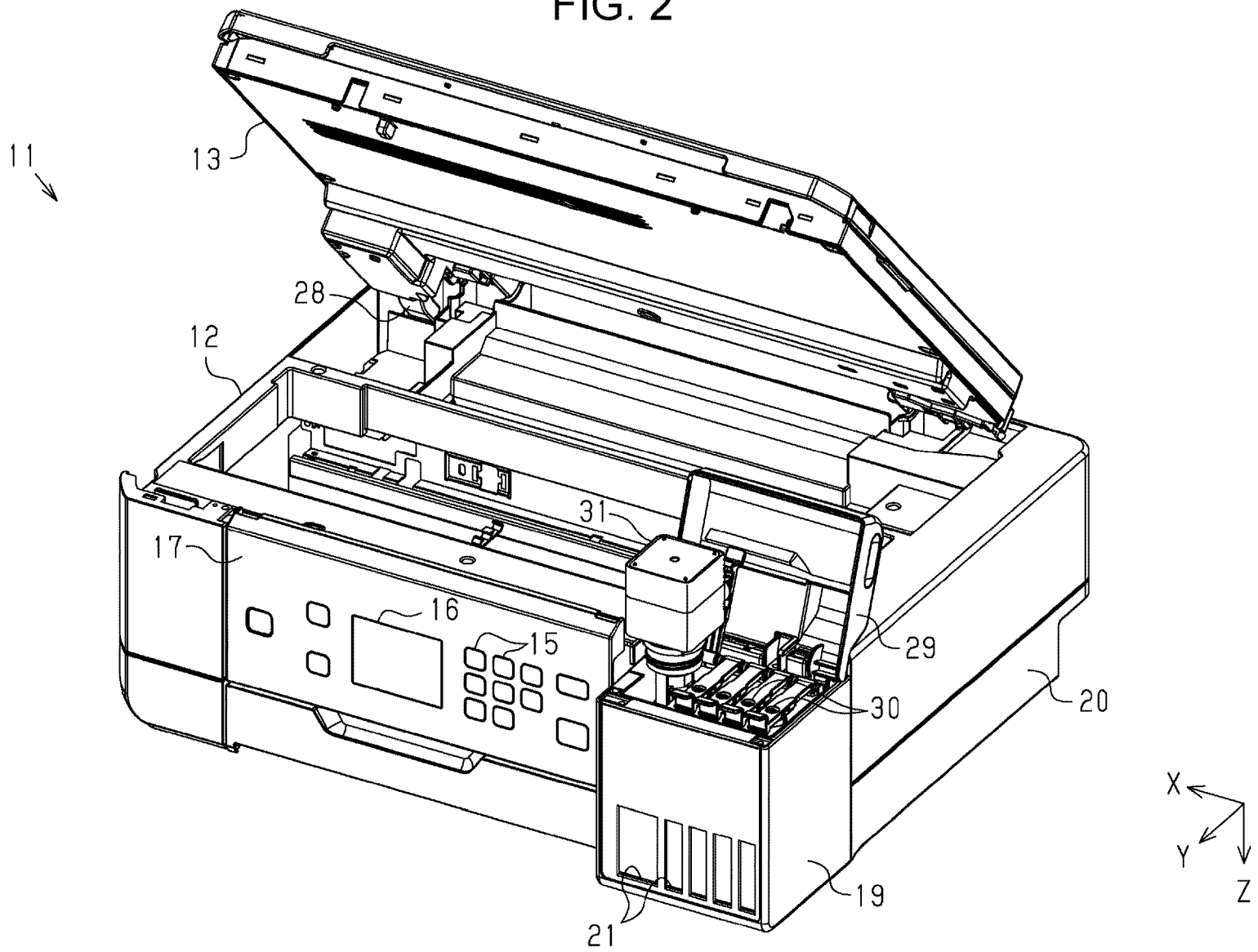
FIG. 2 is a perspective view of the printer to which an embodiment of an ink refill container supplies an ink.

As illustrated in FIG. 2, the image reading device 13 is attached to the printer 12 with a rotation mechanism 28 such as a hinge provided on the back side therebetween. The image reading device 13 can be opened and closed relative to the printer 12 and pivots between a closed position illustrated in FIG. 1 and an open position illustrated in FIG. 2. When the image reading device 13 is in the open position, a unit cover 29 of the housing unit 19 and plugs 30 attached to the ink tanks 18 can be opened and closed. As illustrated in FIG. 2, to have any one of the ink tanks 18 refilled with an ink, the image reading device 13, the unit cover 29, and the corresponding plug 30 are positioned in each open position, and an ink refill container 31 containing an ink refill is coupled to the ink tank 18. That is, the ink refill container 31 is configured to supply the ink tank 18 with an ink.

Figure 3:
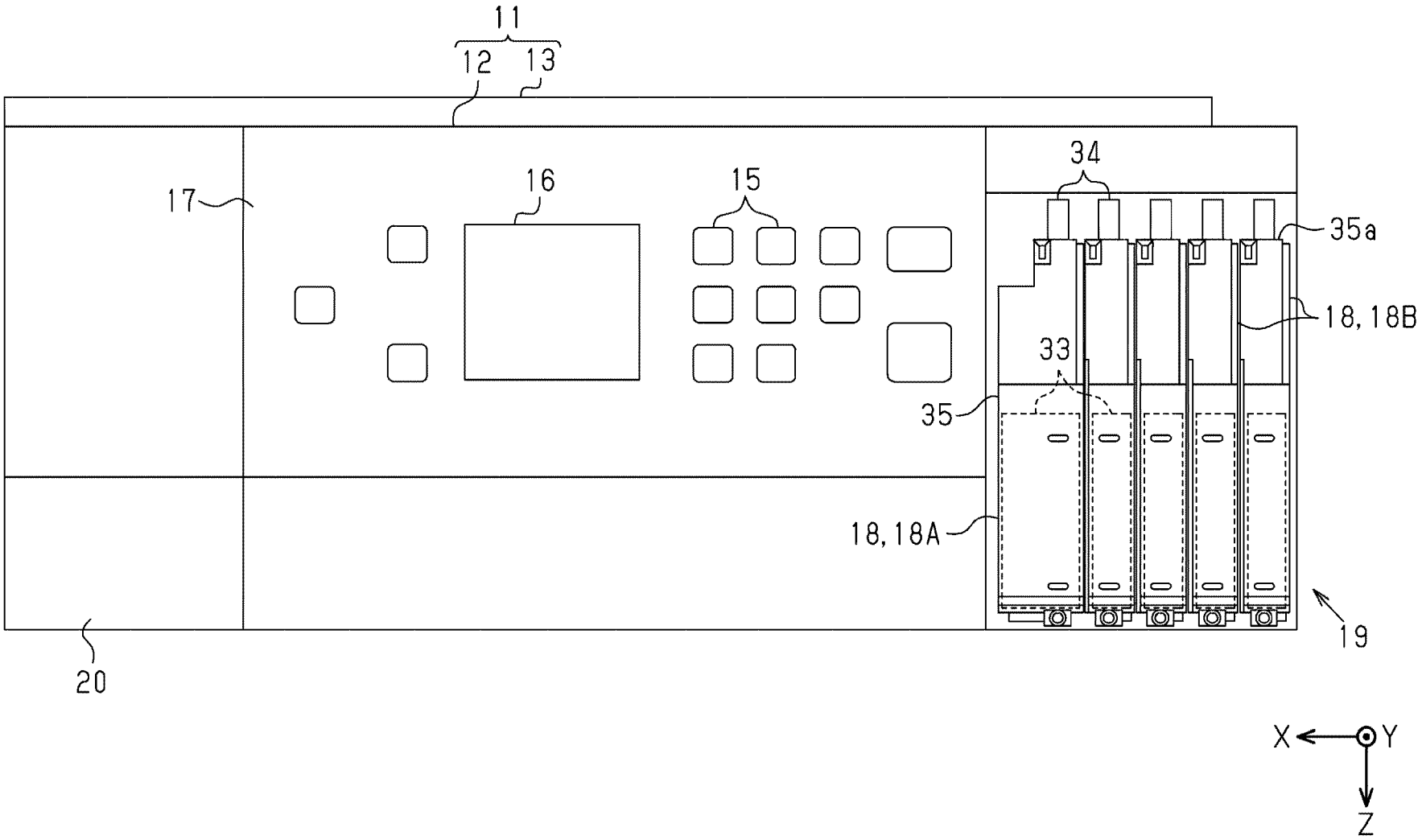
FIG. 3 is a front view of the printer with an illustration of a part of a housing omitted.

As illustrated in FIG. 3, each ink tank 18 includes a storing chamber 33 configured to store an ink, and different types of inks are stored in the different storing chambers 33. The types of inks include, for example, various colors such as cyan, magenta, yellow, and black and various colorants such as pigments and dyes. In the present embodiment, a first ink tank 18A for a black ink with a large storage capacity is provided on the operation panel 17 side, and four second ink tanks 18B for color inks with a capacity smaller than that of the first ink tank 18A are provided.

Each ink tank 18 includes an ink introduction needle 34 configured to introduce an ink into the corresponding storing chamber 33. Each ink introduction needle 34 has a substantially cylindrical form so as to protrude upward from an upper surface 35*a* of a tank case 35 constituting the corresponding ink tank 18. A space in each ink introduction needle 34 communicates with the corresponding storing chamber 33 and has a function of an introduction passage configured to introduce an ink into the corresponding storing chamber 33. Each plug 30 engages the tip of the corresponding ink introduction needle 34 to seal the corresponding introduction passage.

The ink refill container 31 will be described with reference to FIGS. 4 to 13. In FIGS. 4 to 13, the vertical direction is indicated by the Z axis.

Figure 4:
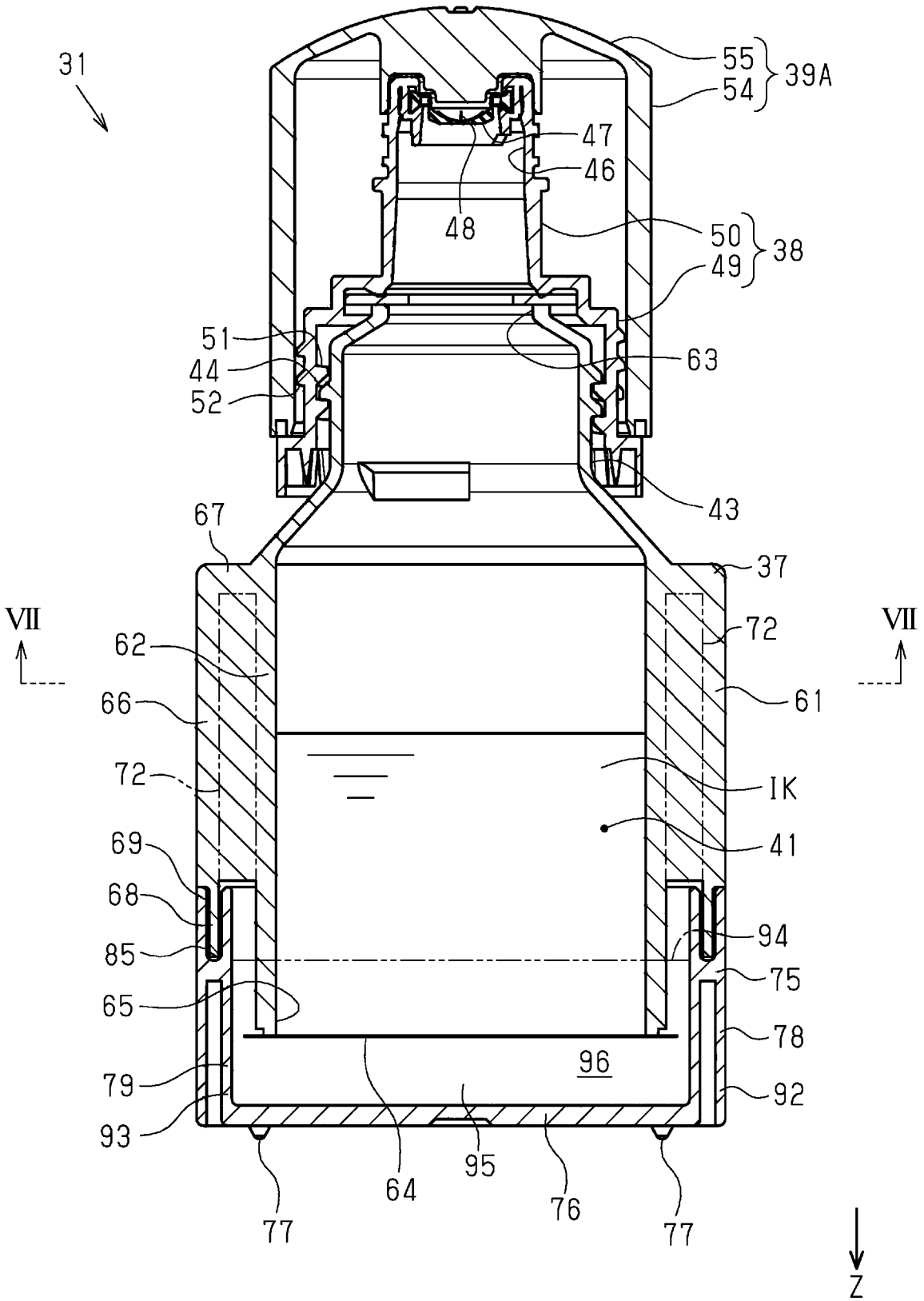
FIG. 4 is a sectional view of the ink refill container.

As illustrated in FIG. 4, the ink refill container 31 includes an ink container body 37 configured to contain an ink, an ink-outlet forming portion 38 provided in the ink container body 37, and a cap member 39A to be attached to the ink-outlet forming portion 38. The ink refill container 31 is a vertical ink refill container whose reference position is a position at which the ink-outlet forming portion 38 and the cap member 39A are positioned at the vertical upper end of the ink container body 37. Directions denoted in the following description are the directions when the ink refill container 31 is in the reference position.

The ink container body 37 includes an ink containing chamber 41 configured to contain an ink IK. The ink container body 37 includes a neck 43 onto which the ink-outlet forming portion 38 is attached. The neck 43 includes a first external thread 44 formed on the outer peripheral surface of the neck 43.

An ink outlet 46 enabling the ink IK in the ink containing chamber 41 to flow out is provided in the ink-outlet forming portion 38. The ink-outlet forming portion 38 includes a valve 47 formed of an elastic member such as a silicon film. A plurality of slits 48 intersecting at the center of the valve 47 at equal angular intervals are formed in the valve 47. The slits 48 may be formed so as to extend through the valve 47 or may be formed so as to extend to a middle part of the valve 47 from the outside toward the ink outlet 46.

Even when the slits 48 extend through the valve 47, the valve 47 seals the ink outlet 46 with the slits 48 closed in a state in which the valve 47 is not pushed from the outside. Thus, the valve 47 functions as an example of a sealing body for sealing the ink outlet 46.

As illustrated in FIG. 4, the ink-outlet forming portion 38 includes a large diameter portion 49 positioned on the outer periphery side of the neck 43 and a small diameter portion 50 forming the ink outlet 46 at a position apart from the ink container body 37 when the ink-outlet forming portion 38 is attached to the ink container body 37. On the inner peripheral surface of the large diameter portion 49, a first internal thread 51 screwable onto the first external thread 44 is formed. The ink-outlet forming portion 38 is attached to the tip of the ink container body 37 by screwing the first internal thread 51 onto the first external thread 44. On the outer peripheral surface of the large diameter portion 49, a second external thread 52 is formed.

The cap member 39A includes a cylindrical side wall 54 and a domed top wall 55 formed at an end of the side wall 54. On the inner peripheral surface of the side wall 54, a second internal thread (not illustrated) is formed. The cap member 39A is attached to the ink-outlet forming portion 38 by screwing the second internal thread onto the second external thread 52. That is, the cap member 39A moves in an attachment direction while rotating and is attached to the ink-outlet forming portion 38. The attachment direction corresponds to the vertical direction in the reference position, that is, the direction in which the ink-outlet forming portion 38 extends and the direction in which the ink outlet 46 opens. When attached to the ink-outlet forming portion 38, the cap member 39A covers the ink outlet 46 formed in the ink-outlet forming portion 38 to conceal the ink outlet 46 from the outside.

As illustrated in FIG. 4, the ink container body 37 includes a container bodybody 61, an inner bottom 64, and a cover 75. The container bodybody 61 includes the above-described neck 43 and a portion forming a peripheral wall of the ink containing chamber 41 that contains the ink IK. The inner bottom 64 is joined to the container bodybody 61 to form a bottom wall of the ink containing chamber 41. The inner bottom 64 according to the present embodiment may be formed of a flexible film or may be formed of a rigid plate. The cover 75 is coupled to the container bodybody 61 to cover the inner bottom 64 from below.

The container body 61 includes an inner tube portion 62 forming the peripheral wall of the ink containing chamber 41, an outer tube portion 66 surrounding a part of the inner tube portion 62 from outside, and an outer-tube coupling portion 67 integrally coupling the upper end of the outer tube portion 66 to the inner tube portion 62. The container body 61 may be made by, for example, an injection molding method using a material that is transparent enough to enable the ink IK contained in the ink containing chamber 41 to be visually identified.

Figure 5:
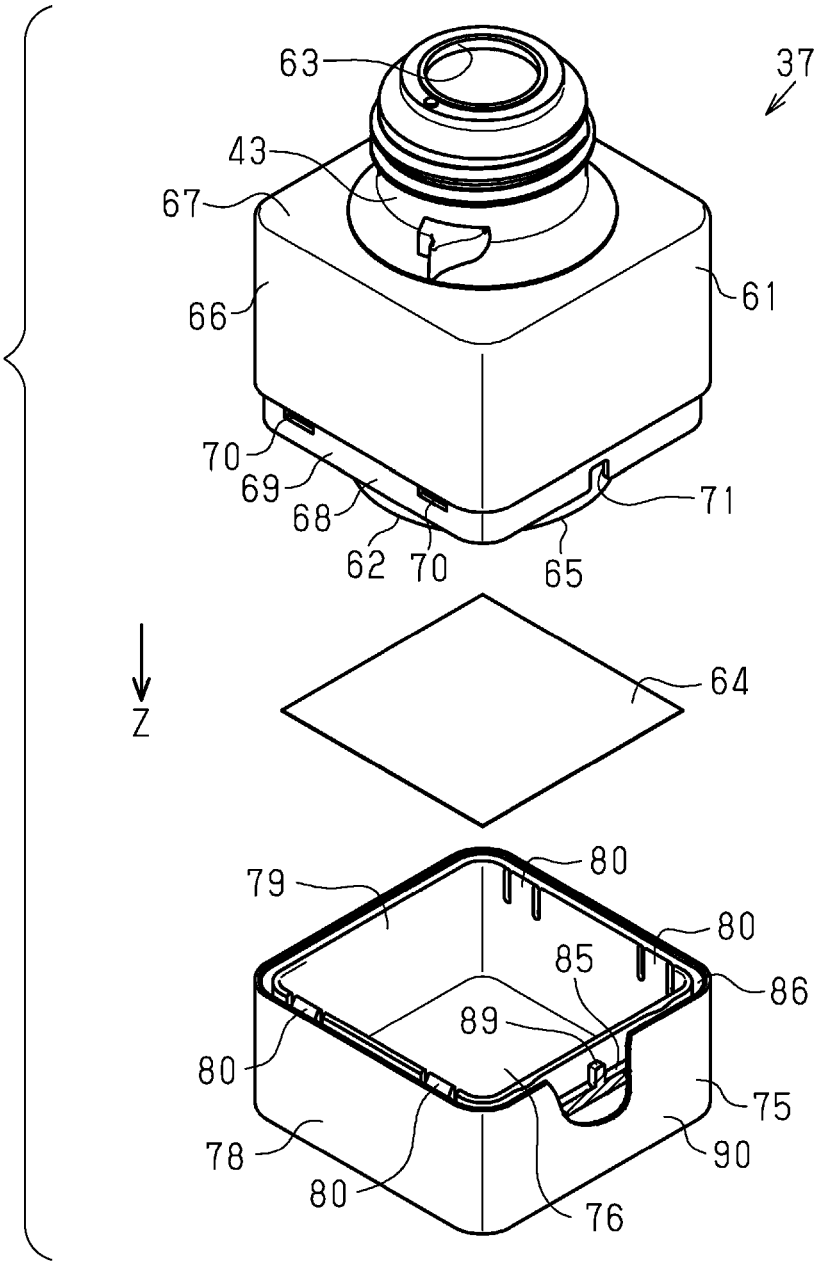
FIG. 5 is an exploded perspective view of an ink container body when viewed from above.
Figure 6:
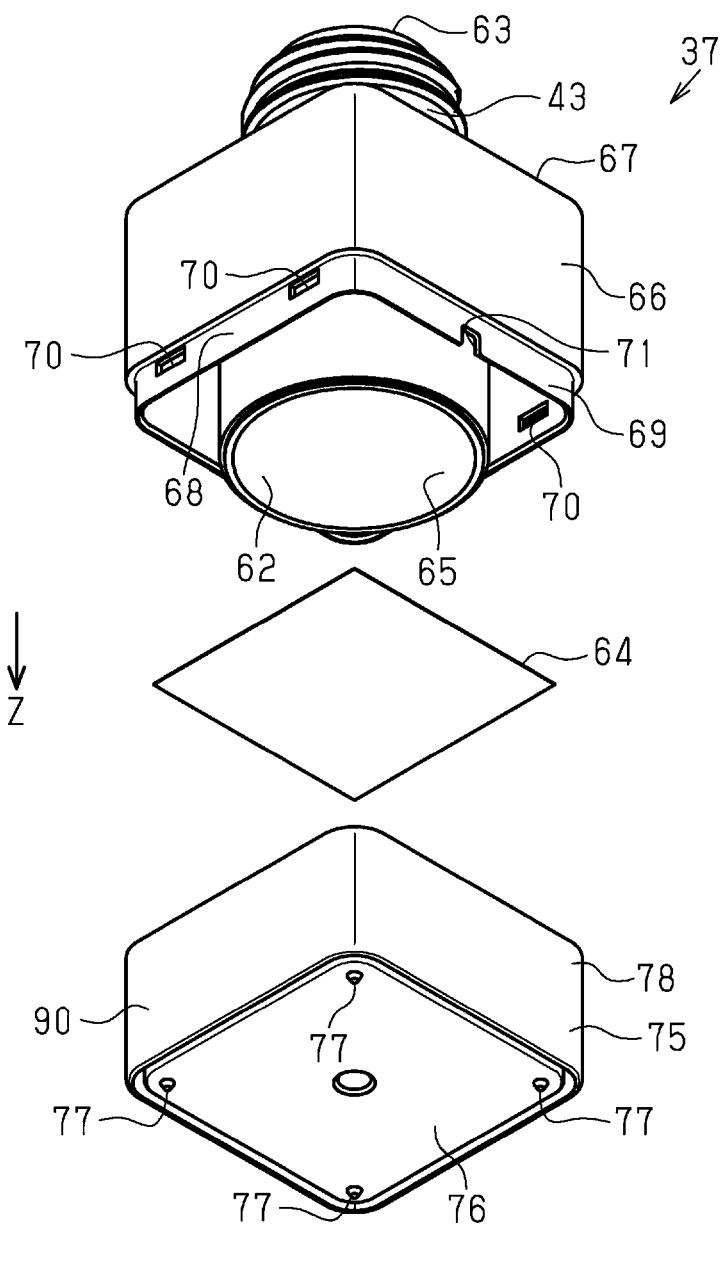
FIG. 6 is an exploded perspective view of the ink container body when viewed from below.

As illustrated in FIG. 5 and FIG. 6, the inner tube portion 62 has a cylindrical form extending in the Z direction. An upper end part of the inner tube portion 62 includes the above-described neck 43 and also includes an outlet opening 63 that discharges the ink IK into the ink outlet 46 formed in the ink-outlet forming portion 38. The lower end of the inner tube portion 62 includes a bottom opening 65 sealed by the inner bottom 64.

The inner bottom 64 forms the bottom wall of the ink containing chamber 41 by sealing the bottom opening 65 of the inner tube portion 62. The inner bottom 64 is joined to the lower end of the inner tube portion 62 by a joining method such as welding or bonding, for example. The inner bottom 64 with flexibility can adjust to the volume changes of the ink IK and air caused by a temperature change. The inner bottom 64 may be made of a material that is transparent enough to enable the ink IK contained in the ink containing chamber 41 to be visually identified.

The outer tube portion 66 includes four outer-tube side-wall portions that have a planar plate-like form and forms a rectangular tube extending in the Z direction. The upper end of the outer tube portion 66 is integrally coupled to a root part of the upper end part of the inner tube portion 62 with the outer-tube coupling portion 67 therebetween. At a lower end part of the outer tube portion 66, a cover coupling portion 68 to which the cover 75 is coupled is formed throughout the entire periphery of the outer tube portion 66. The cover coupling portion 68 is positioned above the bottom opening 65 of the inner tube portion 62 and extends downward. The cover coupling portion 68 is a part thinner than the other part of the outer tube portion 66, and a step 69 is formed in the outer peripheral surface of the outer tube portion 66 as if a part of the lower end part of the outer tube portion 66 was cut out.

In the cover coupling portion 68, an engagement hole 70 in which the cover 75 engages is formed. In the present embodiment, four engagement holes 70 are formed. The engagement holes 70 are formed in two outer-tube side-wall portions, which are opposite to each other, of the four outer-tube side-wall portions constituting the outer tube portion 66. In each of the two outer-tube side-wall portions, the engagement holes 70 are formed at both end parts of the two outer-tube side-wall portions in the peripheral direction of the outer tube portion 66.

The cover coupling portion 68 has a guide groove 71 that aligns the orientations of the container body 61 and the cover 75 with each other to enable the cover 75 to be attached to the container body 61. The guide groove 71 is formed in one of the two outer-tube side-wall portions, which do not have the engagement holes 70, of the four outer-tube side-wall portions constituting the outer tube portion 66.

Figure 7:
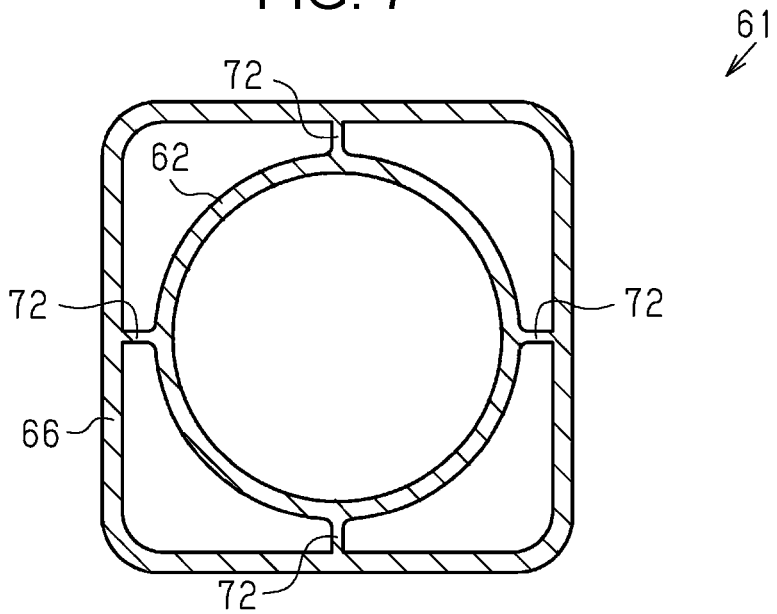
FIG. 7 is an end view taken along line VII-VII of FIG. 4.

As illustrated in FIG. 4 and FIG. 7, the container body 61 includes a reinforcing rib 72 that integrally couples the inner tube portion 62, the outer tube portion 66, and the outer-tube coupling portion 67. In the present embodiment, the container body 61 includes four reinforcing ribs 72. Each reinforcing rib 72 is positioned above the cover coupling portion 68 and is formed into a planar plate extending in the Z direction. A plurality of reinforcing ribs 72 are provided at equal angular intervals in the peripheral direction of the inner tube portion 62 so as to integrally couple the outer-tube side-wall portions to the inner tube portion 62. Each reinforcing rib 72 is positioned away from corners formed of the adjacent outer-tube side-wall portions and is integrally coupled to a center part of the corresponding outer-tube side-wall portion in the peripheral direction of the outer tube portion 66. Each reinforcing rib 72 is provided so as to link the corresponding, planar plate-like outer-tube side-wall portion to the cylindrical inner tube portion 62 in the shortest distance.

As illustrated in FIG. 5 and FIG. 6, the cover 75 includes an outer bottom 76 having a function of a bottom of the ink refill container 31 in the reference position and a cover side wall 78 integrally coupled to the outer bottom 76. The outer bottom 76 is formed into a rectangular plate whose periphery portion is disposed below the cover coupling portion 68 of the container body 61. In a state in which the cover 75 is coupled to the container body 61, the outer bottom 76 includes a portion that is opposite to the inner bottom 64 and that covers the inner bottom 64 from below. The outer bottom 76 includes hemispherical protrusions 77 on all corner parts of the surface facing away from the inner bottom 64. The cover 75 may be made, for example, by an injection molding method using a material that is transparent enough to enable the ink IK contained in the ink containing chamber 41 to be visually identified.

Figure 8:
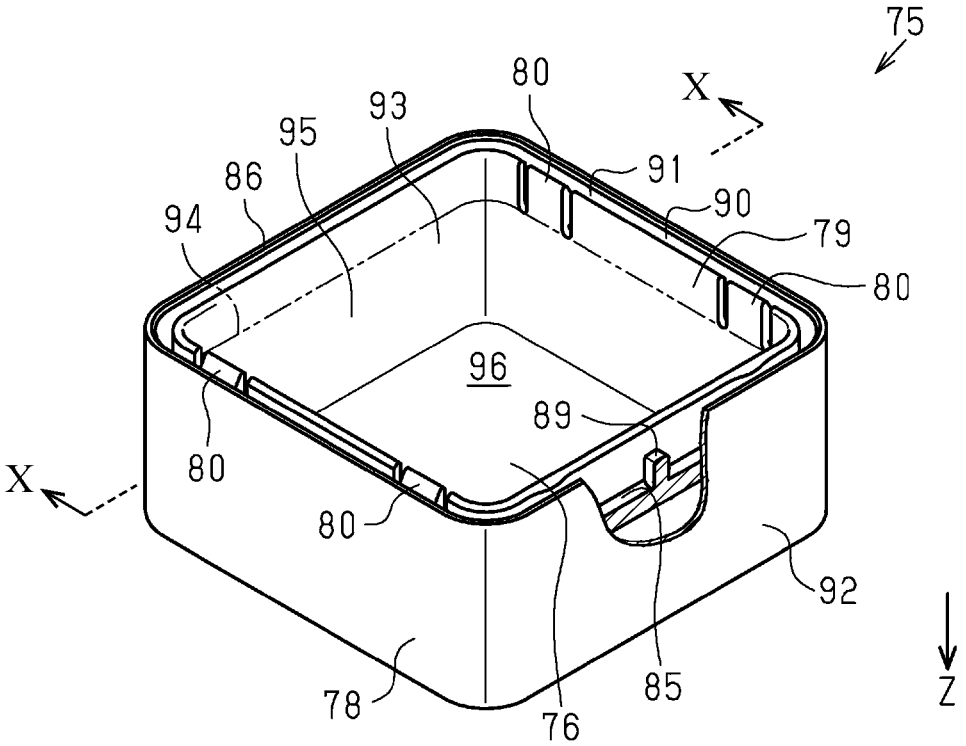
FIG. 8 is a perspective view of a cover when viewed from above.

The cover side wall 78 extends upward from a periphery portion of the outer bottom 76. The cover side wall 78 is coupled to the cover coupling portions 68 of the container body 61. The cover side wall 78 has a double wall structure. The cover side wall 78 includes an inner side wall 79 and an outer side wall 90. A base end of the inner side wall 79 is positioned at the periphery of the outer bottom 76. The outer side wall 90 surrounds the inner side wall 79 from outside. As illustrated in FIG. 8, the inner side wall 79 and the outer side wall 90 are coupled by a side-wall coupling portion 85. The inner side wall 79, the outer side wall 90, and the side-wall coupling portion 85 may be integrally formed.

As illustrated in FIG. 8, the inner side wall 79 is formed into a rectangular tube as a whole. The inner side wall 79 includes snap engagement portions 80 that individually snap engage the plurality of engagement holes 70 formed in the cover coupling portion 68 from inside the outer tube portion 66. The snap engagement portions 80 are body coupling portions that couple the cover 75 to the container body 61.

Figure 9:
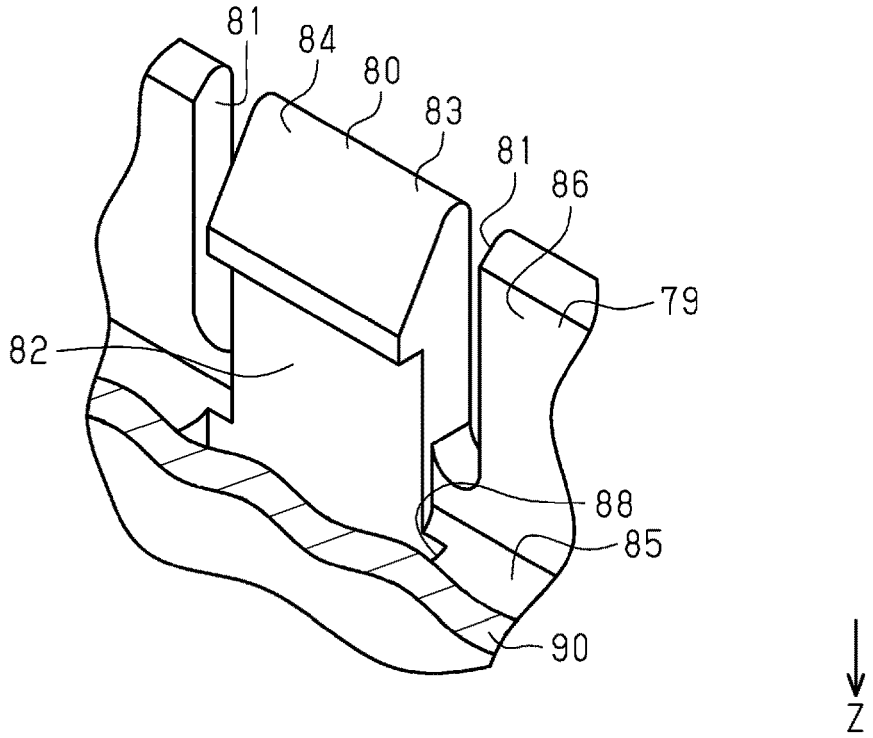
FIG. 9 is an enlarged perspective view of a region around a snap engagement portion of the cover.

As illustrated in FIG. 9, each snap engagement portion 80 includes a snap portion 82 positioned between a pair of cut portions 81 formed in the inner side wall 79 and an engagement claw 83 that is formed at a tip part of the corresponding snap portion 82 and protrudes toward the outer side wall 90. Each engagement claw 83 has an inclined surface 84 formed in such a manner that the gap between the corresponding inclined surface 84 and the outer side wall 90 gradually narrows from the top of the gap.

Figure 10:
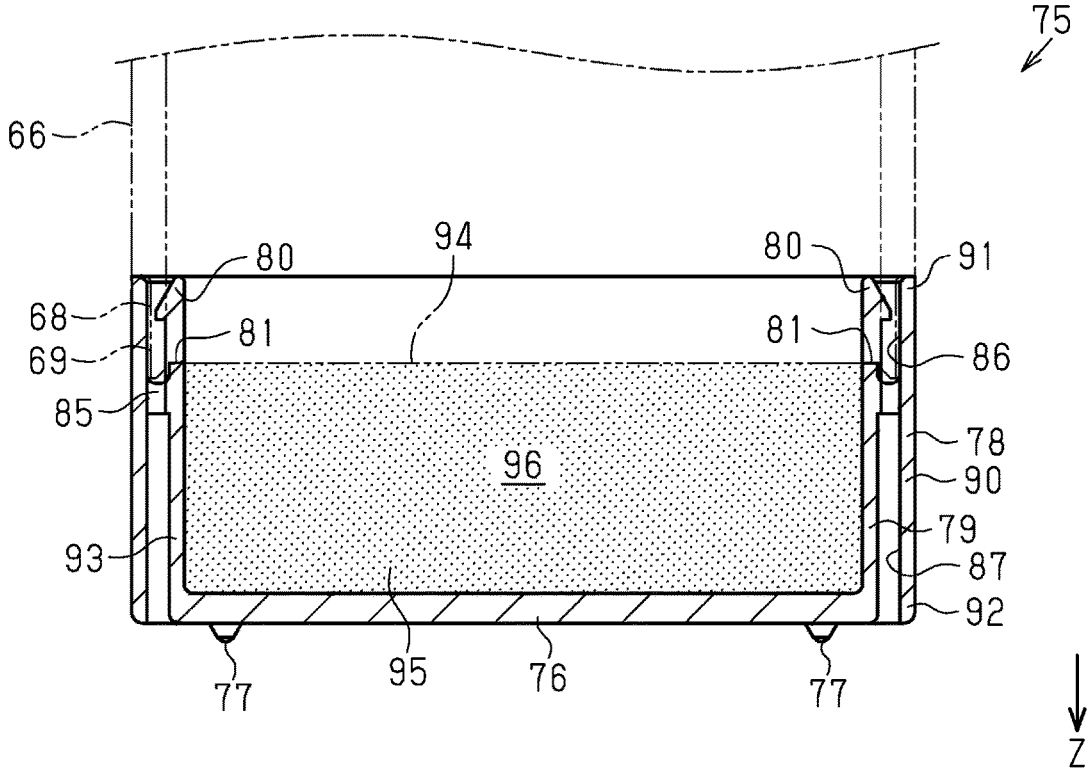
FIG. 10 is a sectional view taken along line X-X of FIG. 8.

As illustrated in FIGS. 8 to 10, the side-wall coupling portion 85 integrally couples a substantially upper end part of the inner side wall 79 and a substantially upper end part of the outer side wall 90. The side-wall coupling portion 85 is positioned on the outer bottom 76 side with respect to the snap engagement portions 80 and discontinuously extends around the entire periphery of the cover side wall 78 in the peripheral direction of the cover side wall 78. The inner side wall 79 is integrally coupled to the outer side wall 90 by the side-wall coupling portion 85 in such a manner that the gap between the inner side wall 79 and the outer side wall 90 is slightly larger than the thickness of the cover coupling portion 68 of the container body 61. Thus, the inner side wall 79, the outer side wall 90, and the side-wall coupling portion 85 form an insertion groove 86 in the cover side wall 78 throughout the entire periphery of the cover side wall 78. The cover coupling portion 68 of the container body 61 is inserted into the insertion groove 86 when the container body 61 and the cover 75 are coupled to each other. The insertion groove 86 is formed to be large enough to house the cover coupling portion 68 of the outer tube portion 66. In the cover side wall 78, a groove 87 that is deeper than the insertion groove 86 is formed at an opposite side of the insertion groove 86 across the side-wall coupling portion 85. As illustrated in FIG. 9, through holes 88 are formed in the side-wall coupling portion 85 at positions below the engagement claws 83 of the snap engagement portions 80. As illustrated in FIG. 8, a guide protrusion 89 that engages the guide groove 71 formed in the cover coupling portion 68 of the container body 61 is formed in the side-wall coupling portion 85.

As illustrated in FIG. 8 and FIG. 10, the outer side wall 90 has a rectangular tubular form and is positioned apart from the inner side wall 79 by a distance as large as the thickness of the side-wall coupling portion 85. The outer side wall 90 has a thickness slightly smaller than the thickness difference between the cover coupling portion 68 and the outer tube portion 66 of the container body 61. Accordingly, in the state in which the cover 75 is coupled to the container body 61, the outer peripheral surface of the cover 75 and the outer peripheral surface of the outer tube portion 66 of the container body 61 are flush with each other. The outer side wall 90 includes a fitting portion 91 that constitutes the insertion groove 86 and extends upward from the coupled part to the side-wall coupling portion 85. The fitting portion 91 is to be fitted with the step 69 of the outer tube portion 66 when the cover 75 is coupled to the container body 61. The fitting portion 91 has a function as a blinding portion that covers the engaged parts of the engagement holes 70 and the snap engagement portions 80 in the state in which the cover 75 is coupled to the container body 61. The outer side wall 90 includes a cushion portion 92 that constitutes the groove 87 and extends downward from the coupled part to the side-wall coupling portion 85. The cushion portion 92 lightens a mechanical load applied to the coupled part of the container body 61 and the cover 75 by bending when the ink refill container 31 drops and lands on the cushion portion 92.

As illustrated in FIG. 10, in the cover 75 having the above-described configuration, a bottomed container-formed receiving recess 95 having a receiving opening 94 at the upper end thereof is formed by the outer bottom 76 and a receiving wall 93 that is a tubular wall positioned below the cut portions 81 in the inner side wall 79. The receiving recess 95 forms a receiving chamber 96 that receives the ink IK that has leaked from the ink containing chamber 41 through a junction of the inner tube portion 62 and the inner bottom 64. The receiving chamber 96 is illustrated as a dotted area in FIG. 10.

The receiving recess 95 enables the ink IK to flow to the outside when the ink IK received in the receiving recess 95 spills. In the ink refill container 31, the ink IK that has flowed to the cut portions 81 from the inside of the inner side wall 79 flows to the outside through the through holes 88 formed in the side-wall coupling portion 85. Thus, the tubular wall constituting the receiving recess 95 is set to be the receiving wall 93 positioned below the cut portions 81. When no through hole 88 is formed in the side-wall coupling portion 85, the tubular wall constituting the receiving recess 95 is configured of the above-described receiving wall 93, the side-wall coupling portion 85, and the fitting portion 91 of the outer side wall 90.

As illustrated in FIG. 4, the receiving recess 95 is configured in such a manner that the receiving opening 94 is positioned above the inner bottom 64. That is, the receiving recess 95 is configured in such a manner that the lower end of the inner tube portion 62 forming the peripheral wall of the ink containing chamber 41 is positioned in the receiving chamber 96. The capacity of the receiving recess 95, that is, the capacity of the receiving chamber 96 is set to be equal to or larger than the amount of the ink IK to be contained in the ink containing chamber 41. That is, the amount of the ink IK to be contained in the ink containing chamber 41 is set to be equal to or smaller than the capacity of the receiving recess 95. The receiving recess 95 is configured in such a manner that the receiving opening 94 is positioned below the liquid level of the ink IK.

Figure 11:
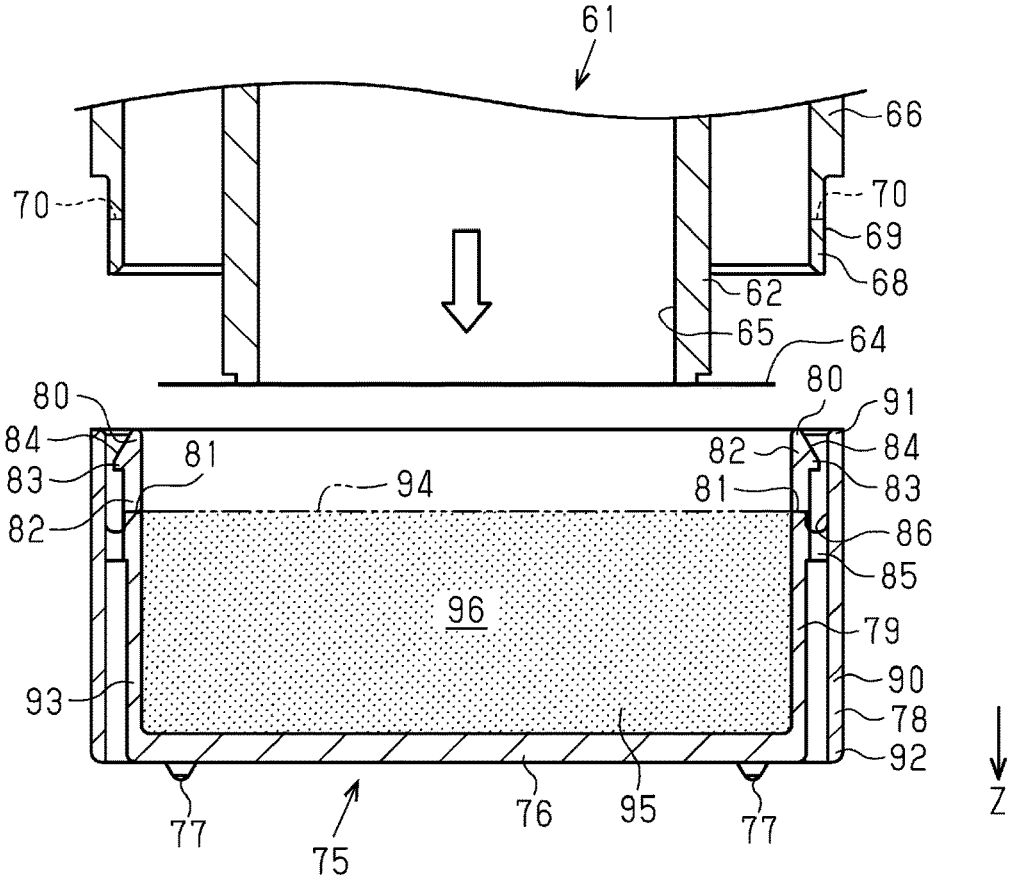
FIG. 11 is a sectional view illustrating a state in which the alignment of a container bodybody and the cover is completed.
Figure 12:
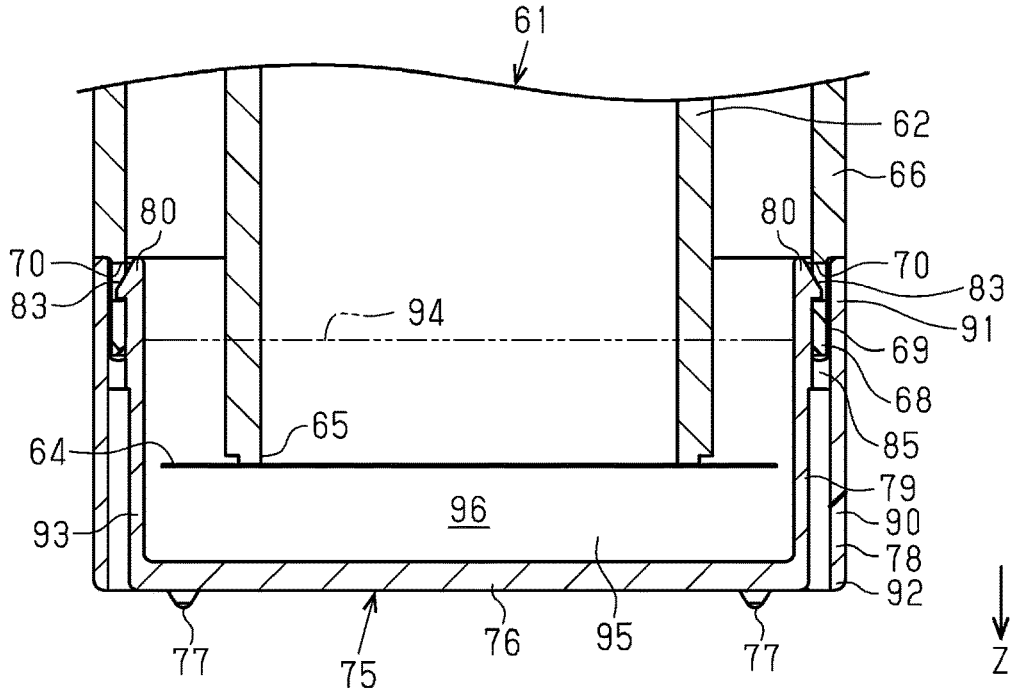
FIG. 12 is a sectional view illustrating a state in which the container bodybody and the cover are coupled to each other.

As illustrated in FIG. 11 and FIG. 12, the above-described coupling of the container body 61 and the cover 75 is performed after the inner bottom 64 is joined to the lower end of the inner tube portion 62 of the container body 61. When the container body 61 and the cover 75 are coupled to each other, the container body 61 and the cover 75 are aligned with each other based on the positional relation between a subset of the engagement holes 70 and the guide groove 71 that are formed in the container body 61 and a subset of the snap engagement portions 80 and the guide protrusion 89 that are formed in the cover 75. The cover coupling portion 68 of the container body 61 is then inserted into the insertion groove 86 of the cover 75. Each snap engagement portion 80 bends toward the inside of the cover 75 when the corresponding inclined surface 84 is pressed by the cover coupling portion 68 that is inserted into the insertion groove 86, and the corresponding engagement claw 83 then snap engages the corresponding engagement hole 70. The fitting portion 91 of the outer side wall 90 fits the step 69 of the outer tube portion 66, and the outer peripheral surface of the outer side wall 90 and the outer peripheral surface of the outer tube portion 66 are flush with each other. Thus, the designability of the ink refill container 31 is improved. All snap engagement portions 80 are snap engaged in the respective engagement holes 70 to complete the coupling operation of the container body 61 and the cover 75.

The container body 61 and the cover 75 have only to be coupled to each other in a state in which the inner bottom 64 is joined to the container body 61. Thus, the container body 61 and the cover 75 may be coupled to each other in a state in which all components except the cover 75 are coupled to the container body 61 or in a state in which only the inner bottom 64 is joined to the container body 61. The ink IK has only to be poured into the ink containing chamber 41 in a state in which the ink IK does not leak from the ink containing chamber 41. Thus, the ink IK may be poured into the ink containing chamber 41 before or after the container body 61 and the cover 75 are coupled to each other.

In the ink refill container 31 having such a configuration, the valve 47 is opened by inserting any one of the ink introduction needles 34 of the corresponding ink tank 18 into the ink outlet 46 after the cap member 39A is removed. In this way, the ink refill container 31 is coupled to the ink tank 18, and the ink tank 18 is supplied, through the ink outlet 46, with the ink IK in the ink containing chamber 41.

Functions and advantageous effects of the present embodiment will be described.

(1) An ink container body 37 of an ink refill container 31 includes a container body 61 including a peripheral wall of an ink containing chamber 41, an inner bottom 64 that is joined to the container body 61 and that forms a bottom wall of the ink containing chamber 41, and a cover 75 including an outer bottom 76 covering the inner bottom 64 from below in a reference position. The cover 75 includes a receiving recess 95 that is configured of the outer bottom 76 and a tubular receiving wall 93 integrally coupled to the outer bottom 76 and extending upward.

With such configurations, for example, even though joining failure occurs at a junction of the container body 61 and the inner bottom 64 and the ink IK in the ink containing chamber 41 leaks through a bottom opening 65, the ink IK does not leak any further, because the outer bottom 76 and the receiving wall 93 of the cover 75 are integrally coupled to each other. Thus, the ink IK that has leaked can be received in the receiving recess 95. That is, because the outer bottom 76 and the receiving wall 93 are integrally coupled to each other, joining failure is not likely to occur at a coupled part of the outer bottom 76 and the receiving wall 93. Thus, it is possible to suppress leakage of the ink IK that has been received in the receiving recess 95 to the outside of the ink refill container 31. Thus, even though the ink IK in the ink containing chamber 41 leaks through the junction of the container body 61 and the inner bottom 64, the ink refill container 31 can suppress leakage of the ink IK that has leaked from the ink containing chamber 41 to the outside.

Figure 13:
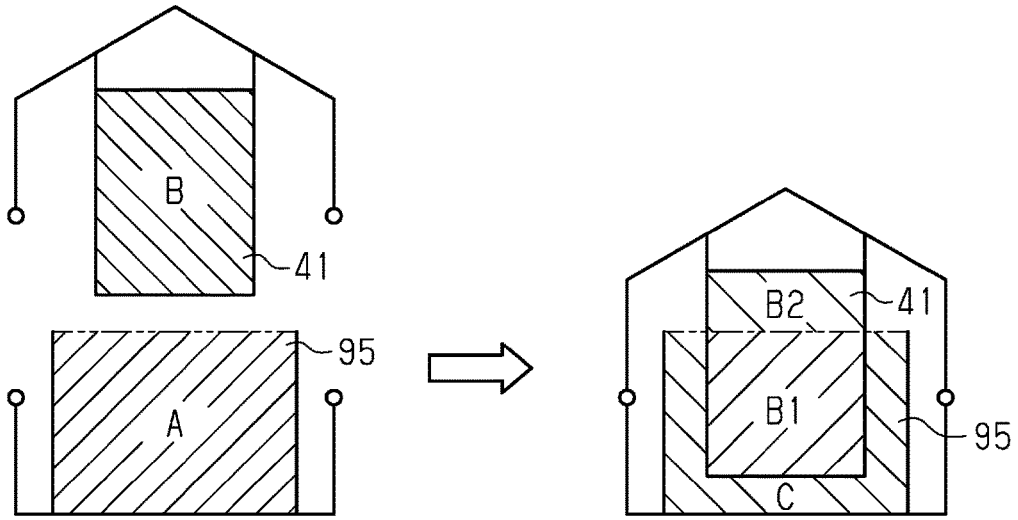
FIG. 13 is a schematic view illustrating a relation between the amount of the ink contained in an ink containing chamber and the capacity of a receiving recess.

(2) The capacity of the receiving recess 95 is set to be equal to or larger than the amount of the ink IK to be contained in the ink containing chamber 41. As illustrated in FIG. 13, for example, when the capacity of the receiving recess 95 is A and the entire amount of the ink IK is B, a relation A>B is established. In addition, a part of the ink containing chamber 41 is positioned in the receiving recess 95. Thus, when the amount of the ink IK in the receiving recess 95 is B1, the amount of the ink IK outside the receiving recess 95 is B2, and the capacity of the receiving recess 95 except a part filled with the ink IK is C, relations A=B1+C and B=B1+B2 are established. Accordingly, because A>B is established, B1+C>B1+B2; that is, C>B2 is established.

In the ink refill container 31 having such a configuration, when the ink IK leaks from the ink containing chamber 41, the ink IK continues flowing into the receiving recess 95 until the liquid level of the ink IK in the ink containing chamber 41 and the liquid level of the ink IK in the receiving recess 95 are at the same height. At this time, at least the amount of B2 of the ink IK flows into the receiving recess 95 from the ink containing chamber 41. When the ink IK of the amount of B2 of the ink IK flows into the part with the capacity C, the liquid level of the ink IK in the receiving recess 95 is below the liquid level of the ink IK in the ink containing chamber 41 because C>B2 is established. Thus, a larger amount of the ink IK than the amount B2 flows from the ink containing chamber 41 into the receiving recess 95, and the liquid level of the ink IK in the ink containing chamber 41 is below the boundary between the amount B1 and the amount B2. That is, because the receiving recess 95 is set to have a capacity equal to or larger than the amount of the ink IK to be contained in the ink containing chamber 41, the receiving recess 95 can further reliably suppress external leakage of the ink IK that has leaked from the ink containing chamber 41.

(3) In the receiving recess 95, a receiving opening 94 formed at the upper end of the receiving recess 95 is positioned above the inner bottom 64. That is, the receiving recess 95 surrounds a part of an inner tube portion 62 from outside, and a junction of the inner tube portion 62 and the inner bottom 64 is positioned in a receiving chamber 96.

Such a configuration is likely to cause leakage of the ink IK in the receiving chamber 96 due to joining failure of the inner tube portion 62 and the inner bottom 64. In such a case, the ink IK that has leaked due to joining failure can be further reliably received in the receiving recess 95. In addition, because a part of the ink containing chamber 41 is positioned in the receiving recess 95, the ink refill container 31 can be downsized while the capacity of the receiving recess 95 is ensured.

(4) The receiving opening 94 provided at the upper end of the receiving recess 95 is positioned below the liquid level of the ink IK contained in the ink containing chamber 41 in the reference position of the ink refill container 31.

In such a configuration, the outer bottom 76 and the receiving wall 93 need to be expanded in the plane direction of the outer bottom 76 so as to ensure the capacity of the receiving recess 95. To satisfy such a need, the outer bottom 76 of the ink refill container 31 is enlarged; thus, the ink refill container 31 in the reference position can be stabilized. When the container body 61 is transparent enough to enable the ink IK contained in the ink containing chamber 41 to be visually identified, the liquid level of the ink IK contained in the ink containing chamber 41 can be visually identified. In addition, when the container body 61 is transparent, scales may be provided on the surface of the container body 61 so that the amount of the remaining ink can be identified in a specific manner.

(5) The container body 61 is transparent enough to enable the ink IK contained in the ink containing chamber 41 to be visually identified. Accordingly, the presence or absence of leakage of the ink IK from the ink containing chamber 41 can be identified based on the amount or the liquid level of the ink IK in the ink containing chamber 41. Thus, a user can handle the ink refill container 31 in accordance with the presence or absence of leakage of the ink IK.

(6) The cover 75 is transparent enough to enable the ink IK received in the ink refill container 31 to be visually identified. Thus, a user can visually identify the presence or absence of leakage of the ink IK from the ink containing chamber 41 into the receiving recess 95. Thus, a user who has identified leakage of the ink IK can handle the ink refill container 31 without the ink IK spilling from the receiving recess 95.

(7) When the liquid level of the ink IK is above the receiving opening 94 and the container body 61 and the cover 75 are semitransparent, a part of the ink IK in the ink containing chamber 41 is visually identified only through the container body 61, and the other part of the ink IK in the ink containing chamber 41 is visually identified through the container body 61 and the cover 75. Thus, the ink refill container 31 is visually identified as if inks IK of two colors were contained in the ink containing chamber 41. Accordingly, the designability of the ink refill container 31 can be improved.

(8) The container body 61 includes a cover coupling portion 68 in an outer tube portion 66 that is integrally coupled to the inner tube portion 62 with an outer-tube coupling portion 67 therebetween and that surrounds a part of the inner tube portion 62 from outside. The cover 75 includes snap engagement portions 80 that are body coupling portions formed in a cover side wall 78 integrally coupled to the outer bottom 76. That is, the cover 75 is supported by the inner tube portion 62, which forms a peripheral wall of the ink containing chamber 41, with the outer tube portion 66 and the outer-tube coupling portion 67 therebetween.

Such a configuration can hinder the force of an impact acting on the cover 75 due to a cause, such as a drop, from directly acting on the inner tube portion 62 and can thus suppress the deformation of the inner tube portion 62 due to the impact. Accordingly, it is possible to suppress the occurrence of joining failure at the junction of the inner tube portion 62 and the inner bottom 64 due to the force of an impact acting on the cover 75.

(9) In a state in which the cover 75 is coupled to the container body 61, the cover coupling portion 68 of the container body 61 is inserted into an insertion groove 86 of the cover side wall 78. Such a configuration can enhance the mechanical strength of the coupled part of the container body 61 and the cover 75 because a part of the cover 75 is positioned on the inner and outer sides of the cover coupling portion 68.

(10) When, for example, the ink refill container 31 drops, an inertial force derived from the inertia of the ink IK contained in the ink containing chamber 41 acts on the inner tube portion 62, and the inner tube portion 62 may bend with the coupled part of the inner tube portion 62 and the outer-tube coupling portion 67 as a support. The bending of the inner tube portion 62 is one of the causes of joining failure at the junction of the inner tube portion 62 and the inner bottom 64 because a mechanical load is applied to the junction.

In this respect, the container body 61 includes a plurality of reinforcing ribs 72 that integrally couple the inner tube portion 62, the outer tube portion 66, and the outer-tube coupling portion 67 to each other and that enhance not only the mechanical strength of the container body 61 but also the mechanical strength of the ink refill container 31. Such a configuration can suppress the bending of the inner tube portion 62 due to the above-described inertial force; thus, joining failure at the junction of the inner tube portion 62 and the inner bottom 64 is less likely to occur.

(11) When the outer tube portion 66 of the container body 61 is cylindrical, the force of an impact due to a drop is concentrated, via the corresponding reinforcing rib 72, on the inner tube portion 62, in a case in which the ink refill container 31 drops and lands on any coupled part of the reinforcing ribs 72 and the outer tube portion 66. Even though the outer tube portion 66 has a rectangular tubular form, the force of an impact due to a drop is concentrated, via the corresponding reinforcing rib 72, on the inner tube portion 62, when the reinforcing ribs 72 are coupled to corners formed of the adjacent outer-tube side-wall portions and the ink refill container 31 drops and lands on any one of such corners.

In this respect, the outer tube portion 66 of the container body 61 is formed into a rectangular tube including planar plate-like outer-tube side-wall portions, and each reinforcing rib 72 is provided at a position apart from the corners formed of the adjacent outer-tube side-wall portions. Thus, when the ink refill container 31 drops, the force of an impact due to a drop can be effectively dispersed. Accordingly, the concentration of an impact force resulting from a drop on the inner tube portion 62 can be suppressed via the reinforcing ribs 72.

(12) Each reinforcing rib 72 is integrally coupled to a center part of the corresponding outer-tube side-wall portion in the peripheral direction of the outer tube portion 66 so as to link the corresponding outer-tube side-wall portion to the cylindrical inner tube portion 62 in the shortest distance. Such a configuration can reduce the amount of a material used for the container body 61 while enhancing the mechanical strength of the container body 61.

(13) The cover side wall 78 of the cover 75 has a double wall structure including an inner side wall 79 and an outer side wall 90. Such a configuration can enhance the mechanical strength of the entire cover 75.

(14) In the cover 75, the snap engagement portions 80 are formed in the inner side wall 79 surrounded by the outer side wall 90 from outside. Such a configuration can protect the snap engagement portions 80 with the outer side wall 90, for example, when the cover 75 is handled alone.

(15) In the cover 75, a side-wall coupling portion 85 couples a substantially upper end part of the inner side wall 79 and a substantially upper end part of the outer side wall 90, that is, parts near the snap engagement portions 80 that are the body coupling portions. Such a configuration can shorten the snap portions 82 of the snap engagement portions 80 and can enhance not only the mechanical strength of the entire snap engagement portions 80 but also the mechanical strength of the coupled part of the container body 61 and the cover 75.

(16) The container body 61 includes the inner tube portion 62, the outer tube portion 66 surrounding a part of the inner tube portion 62 from outside, and the outer-tube coupling portion 67 integrally coupling the upper end of the outer tube portion 66 to the inner tube portion 62. Thus, when the ink refill container 31 receiving the ink IK in the receiving recess 95 is turned inverted, the ink IK in the receiving recess 95 can flow into a region surrounded by the inner tube portion 62, the outer tube portion 66, and the outer-tube coupling portion 67. Accordingly, external leakage of the ink IK that has leaked from the ink containing chamber 41 can be suppressed. Such an advantageous effect is more considerable when the capacity of the region surrounded by the inner tube portion 62, the outer tube portion 66, and the outer-tube coupling portion 67 is larger than the capacity of the receiving recess 95.

The present embodiment may be modified and implemented as described below. The present embodiment and the following modifications can be combined with each other unless a technical contradiction arises.

At least one of the container body 61 and the cover 75 may be formed of a material opaque enough to conceal the ink IK received in the ink refill container 31 without being visually identified.

When the ink refill container 31 is in the reference position, the receiving opening 94 formed at the upper end of the receiving recess 95 may be at the same position as the liquid level of the ink IK contained in the ink containing chamber 41 or at a position above the liquid level of the ink IK.

In the ink refill container 31, the inner bottom 64 may be positioned above the receiving opening 94 of the receiving recess 95 so that the inner bottom 64 is positioned outside the receiving recess 95. In such a configuration, the bottom opening 65 of the inner tube portion 62 may be positioned in the receiving opening 94 of the receiving wall 93 when the ink refill container 31 is viewed in the Z direction of the inner tube portion 62.

The capacity of the receiving recess 95 may be smaller than the amount of the ink IK contained in the ink containing chamber 41.

Figure 14:
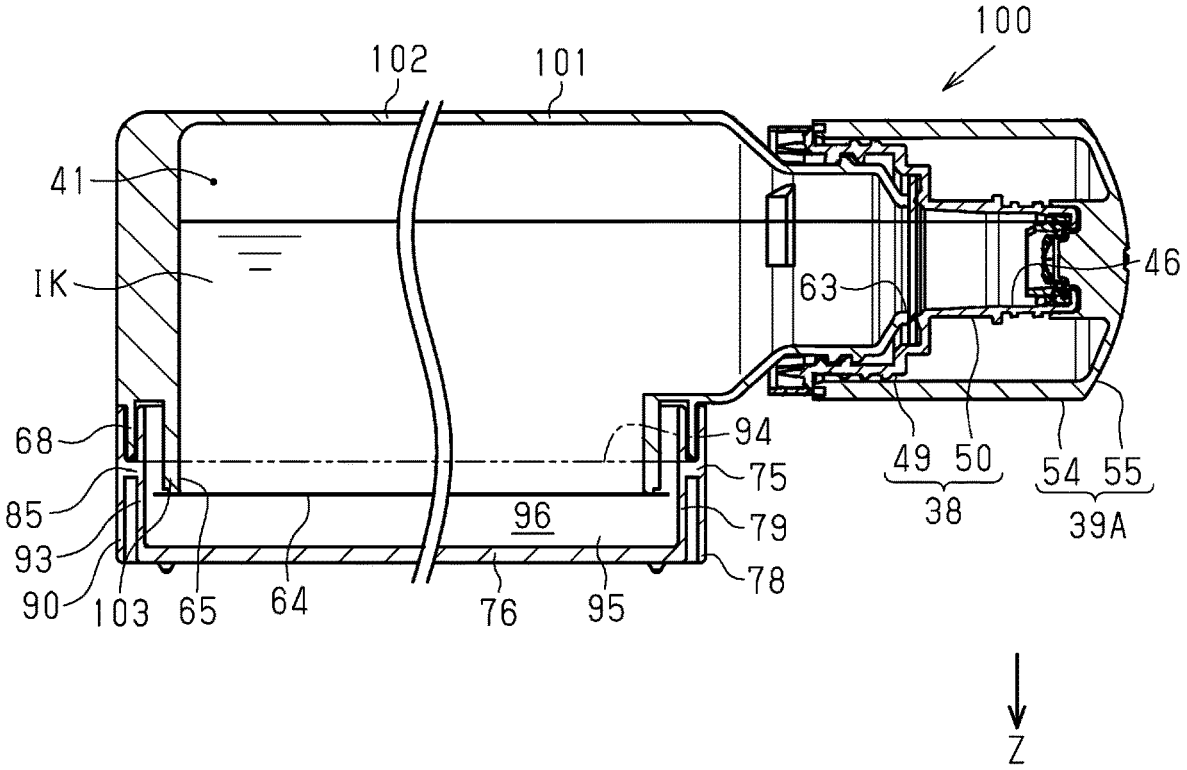
FIG. 14 is a sectional view of a horizontal ink refill container according to a modification.

The ink refill container 31 is not limited to a vertical ink refill container and may be a horizontal ink refill container in which the longitudinal direction of the ink containing chamber 41 is set to intersect the vertical direction when the ink refill container 31 is in a reference position of the horizontal ink refill container. An example of such a horizontal ink refill container will be described with reference to FIG. 14. In FIG. 14, the vertical direction is indicated by the Z axis. The example of the horizontal ink refill container will be described in such a manner that components that are different from those of the above-described ink refill container 31 will be described in detail, whereas components that are the similar to those of the ink refill container 31 will be indicated by the same reference signs, and descriptions of such components will be omitted.

FIG. 14 illustrates an ink refill container 100 as an example of a horizontal ink refill container. A container body 101 of the ink refill container 100 includes a first tube portion 102 and a second tube portion 103 that are integrally coupled to each other. The first tube portion 102 and the second tube portion 103 form a peripheral wall of an ink containing chamber 41. The first tube portion 102 includes the outlet opening 63 at one end thereof, and the other end is closed. The second tube portion 103 is integrally coupled relative to a part between the one end and the other end of the first tube portion 102 and includes the bottom opening 65 communicating with an inner space of the first tube portion 102. In the container body 101, the cover coupling portion 68 is integrally coupled to the first tube portion 102 so as to surround the second tube portion 103.

The cover 75 may be configured in such a manner that the inner side wall 79 and the outer side wall 90 are integrally coupled to the outer bottom 76. That is, the cover 75 may be configured in such a manner that the outer side wall 90 is integrally coupled to a periphery part of the outer bottom 76, and the inner side wall 79 is integrally coupled to a part of the outer bottom 76 at a position more inward than the periphery part.

In the cover 75, the snap engagement portions 80 that are the body coupling portions may be formed in the outer side wall 90.

In the cover 75, the inner side wall 79 and the outer side wall 90 may be integrally coupled to the outer bottom 76, and the snap engagement portions 80 that are body coupling portions may be formed in the outer side wall 90. Such a configuration improves the flexibility in a position at which the inner side wall 79 is formed. Thus, for example, the inner side wall 79 can extend from the outer bottom 76 toward a space between the inner tube portion 62 and the outer tube portion 66 of the container body 61. Thus, the outer bottom 76 and the inner side wall 79 can constitute a first receiving recess, and the outer bottom 76, the inner side wall 79, and the outer side wall 90 can constitute a second receiving recess that receives the ink IK that has spilled from the first receiving recess. The capacity of the second receiving recess may be set to be equal to or larger than the amount of the ink IK to be contained in the ink containing chamber 41.

When the cover 75 is configured in such a manner that the inner side wall 79 is integrally coupled to a part of the outer bottom 76 at a position more inward than the periphery part of the outer bottom 76, the body coupling portions such as the snap engagement portions 80 may be formed at the periphery part of the outer bottom 76.

The cover side wall 78 is not limited to having a double tube structure in which the inner side wall 79 and the outer side wall 90 are integrally coupled by the side-wall coupling portion 85. For example, the cover side wall 78 may be configured of a tubular side wall and a body coupling portion formed at the upper end of the side wall. In such a configuration, the side wall has a function of a receiving wall.

The container body 61 has only to include a portion forming a peripheral wall of the ink containing chamber 41. Thus, the container body 61 may not necessarily include any reinforcing ribs 72. In the inner tube portion 62 of the container body 61, a portion forming the ink containing chamber 41 is not limited to a cylindrical portion and may be a polygonal tubular portion. The outer tube portion 66 is not limited to having a rectangular tubular form and may have a cylindrical form or polygonal tubular form. The container body 61 is not limited to having a double tube structure including the inner tube portion 62 and the outer tube portion 66 and may be configured of, for example, the inner tube portion 62 and the cover coupling portion 68 formed at the outer peripheral surface of the inner tube portion 62.

The container body 61 and the cover 75 are not necessarily coupled by snap engagement and may be coupled, for example, in such a manner that the cover coupling portion 68 is inserted into the insertion groove 86 to be coupled to the insertion groove 86, for example by bonding.

Technical ideas that are graspable from the above-described embodiment and modifications will be described.

An ink refill container including an ink containing chamber configured to contain an ink to be supplied to an ink tank configured to store the ink in the ink tank includes a container body including a peripheral wall of the ink containing chamber, an inner bottom that is joined to the container body and that forms a bottom wall of the ink containing chamber, an ink-outlet forming portion that is provided in the container body and that includes an ink outlet configured to enable the ink to flow out from an inside of the ink containing chamber, and a cover including an outer bottom being opposite to the inner bottom at an outside of the ink containing chamber. When a position in which the outer bottom is positioned below the inner bottom is defined as a reference position of the ink refill container, the cover includes a receiving recess that is configured of the outer bottom and a tubular wall integrally coupled to the outer bottom and extending upward from the outer bottom in the reference position and that receives the ink leaked from the ink containing chamber through a junction of the container body and the inner bottom.

With the ink refill container having the above-described configuration, even though the ink in the ink containing chamber may leak due to, for example, joining failure of the container body and the inner bottom, the receiving recess can receive the ink. In addition, because the outer bottom and the tubular wall are integrally coupled to each other, joining failure does not occur at the coupled part of the outer bottom and the tubular wall. Thus, it is possible to suppress leakage of the ink received in the receiving recess to the outside of the ink refill container. That is, even though the ink in the ink containing chamber leaks through a junction of the container body and the inner bottom, the ink refill container having the above-described configuration can suppress external leakage of the ink that has leaked.

In the ink refill container, the receiving recess may have a capacity equal to or larger than an amount of the ink contained in the ink containing chamber.

The above-described configuration enables the receiving recess to receive all the ink contained in the ink containing chamber. Thus, external leakage of the ink that has leaked from the ink containing chamber can be further reliably suppressed.

In the ink refill container, the inner bottom may be positioned in the receiving recess.

With the above-described configuration, ink leakage through the junction of the container body and the inner bottom occurs in the receiving recess. In such a case, the receiving recess can further reliably receive the ink that has leaked from the ink containing chamber. In addition, because a part of the ink containing chamber is positioned in the receiving recess, the ink refill container can be downsized while the capacity of the receiving recess is ensured.

In the ink refill container, an upper end of the receiving recess may be positioned below a liquid level of the ink contained in the ink containing chamber in the reference position.

With the above-described configuration, the receiving recess is formed to be larger in the plane direction of the outer bottom for ensuring the capacity of the receiving recess. Thus, the ink refill container in the reference position can be stabilized.

In the ink refill container, the container body and the cover may be transparent enough to enable the ink in the ink refill container to be visually identified.

The above-described configuration enables a user to visually identify leakage of the ink to the receiving recess. Thus, when identifying leakage of the ink to the receiving recess, a user can handle the ink refill container without the ink spilling from the receiving recess. A user can also simply identify the amount of the remaining ink in the ink refill container.

An ink refill system includes an ink tank configured to store an ink in the ink tank and an ink refill container that contains the ink to be supplied to the ink tank. The ink refill container including an ink containing chamber configured to contain the ink to be supplied to the ink tank configured to store the ink in the ink tank includes a container body including a peripheral wall of the ink containing chamber, an inner bottom that is joined to the container body and that forms a bottom wall of the ink containing chamber, an ink-outlet forming portion that is provided in the container body and that includes an ink outlet configured to enable the ink to flow out from an inside of the ink containing chamber, and a cover including an outer bottom being opposite to the inner bottom at an outside of the ink containing chamber. When a position in which the outer bottom is positioned below the inner bottom is defined as a reference position of the ink refill container, the cover includes a receiving recess that is configured of the outer bottom and a tubular wall integrally coupled to the outer bottom and extending upward from the outer bottom in the reference position and that receives the ink leaked from the ink containing chamber through a junction of the container body and the inner bottom. With the ink refill system having the above-described configurations, advantageous effects similar to those of the above-described ink refill container can be attained.

What is claimed is:

1. An ink refill container comprising:

an ink containing chamber configured to contain an ink to be supplied to an ink tank configured to store the ink;

a container body including:

a peripheral wall of the ink containing chamber; and a cover coupling portion;

an inner bottom that is joined to the container body and forms a bottom wall of the ink containing chamber;

an ink-outlet forming portion that is provided in the container body and includes an ink outlet configured to enable the ink to flow out from an inside of the ink containing chamber;

a cover including a receiving recess configured to receive ink leaked from the ink containing chamber through a junction of the container body and the inner bottom, the receiving recess being formed by:

an outer bottom opposite to the inner bottom at an outside of the ink containing chamber; and a tubular wall integrally coupled to the outer bottom and extending upward from the outer bottom in a reference position of the ink refill container in which the outer bottom is positioned below the inner bottom; and an insertion groove of the tubular wall, that receives the cover coupling portion therein.

2. The ink refill container according to claim 1, wherein the receiving recess has a capacity equal to or larger than an amount of the ink contained in the ink containing chamber.

3. The ink refill container according to claim 1, wherein the inner bottom is positioned in the receiving recess.

4. The ink refill container according to claim 3, wherein an upper end of the receiving recess is positioned below a liquid level of the ink contained in the ink containing chamber in the reference position.

5. The ink refill container according to claim 1, wherein the container body and the cover are transparent enough to enable the ink in the ink refill container to be visually identified.

6. An ink refill system, comprising:

the ink tank;

the ink refill container according to claim 1; and the ink, contained in the ink refill container.

* * * * *